US006321693B1

(12) United States Patent
Kim et al.

(10) Patent No.: US 6,321,693 B1
(45) Date of Patent: Nov. 27, 2001

(54) RECIPROCATING ROTARY PISTON SYSTEM AND PRESSURE PUMP AND INTERNAL COMBUSTION ENGINE USING THE SAME

(76) Inventors: Chang Kyun Kim, 280 cheonjeon-ri, Imha-mean, Andong-city, Kyungbuk; Seung Kyun Kim, 203-118 cheongryangri 2-dong, Dongdaemun-ku, Seoul, both of (KR)

( * ) Notice: Subject to any disclaimer, the term of this patent is extended or adjusted under 35 U.S.C. 154(b) by 0 days.

(21) Appl. No.: 09/529,419

(22) PCT Filed: Dec. 2, 1998

(86) PCT No.: PCT/KR98/00393

§ 371 Date: May 1, 2000

§ 102(e) Date: May 1, 2000

(87) PCT Pub. No.: WO00/32908

PCT Pub. Date: Jun. 8, 2000

(51) Int. Cl.[7] ..... F02B 53/00

(52) U.S. Cl. ..... 123/18 R; 123/211; 418/36; 418/37; 418/35

(58) Field of Search ..... 123/211, 202, 123/210, 245, 18 R; 418/37, 36, 35

(56) References Cited

U.S. PATENT DOCUMENTS 3,592,571 * 7/1971 Drury ..... 418/36
3,702,746 * 11/1972 Parmerlee ..... 123/18 R
3,719,438 * 3/1973 Howard ..... 418/36
3,910,239 10/1975 James .
3,922,118 * 11/1975 Bancroft ..... 418/37
3,989,012 * 11/1976 Doundoulakis ..... 418/36
5,537,937 * 7/1996 Wittry ..... 123/211

FOREIGN PATENT DOCUMENTS

1055004 * 10/1953 (FR) ..... 418/36
WO 95/15429 6/1995 (WO) .

* cited by examiner

*Primary Examiner*—Thomas Denion
*Assistant Examiner*—Thai-Ba Trieu
(74) *Attorney, Agent, or Firm*—Rosenberg, Klein & Lee

(57) ABSTRACT

A reciprocating rotary piston system includes a cylinder (3) having an annular and hollow interior; a plurality of pistons (1A to 1D) of which first and second parties are formed to be disposed alternately on the same inner circumference of the cylinder, the first and second parties of the pistons reciprocating along a given arc at the same speed and in the opposite direction with respect to each other; a plurality of intake valves (4A to 4D) mounted at each point of the cylinder where the two adjacent pistons meet for controlling flow of a fluid introduced therein to from the outside; and a plurality of exhaust valves (5A to 5D) mounted at each point of the cylinder where the two adjacent pistons meet for controlling flow of a fluid forced out from the inside. The piston system is used for a hydraulic/pneumatic pump, a vacuum pump and an internal combustion engine.

12 Claims, 8 Drawing Sheets

FIRST STEP

SECOND STEP

THIRD STEP

FOURTH STEP

FIFTH STEP

FIRST STEP

SECOND STEP

THIRD STEP

FOURTH STEP

FIFTH STEP

RECIPROCATING ROTARY PISTON SYSTEM AND PRESSURE PUMP AND INTERNAL COMBUSTION ENGINE USING THE SAME

This application is an 371 of PCT/KR98/00393, Dec. 2, 1998.

TECHINCAL FIELD

The present invention generally relates to a reciprocating rotary piston system and a pressure pump and an internal combustion engine using the same. More particularly, it relates to a reciprocating rotary piston system which has a plurality of pistons alternately disposed on the same inner circumference of its cylinder and two adjacent parties of those pistons forward rotating and reversely rotating at the same speed and in the opposite direction with respect to each other in a way that their resultant force becomes zero, and reduces vibration, noise, and eccentric abrasion during operation, thus assuring a small-sized and light main body, long life of a machine, and high performance. It further relates to an internal combustion engine, a hydraulic/pneuatic pump, and a vacuum pump using the same.

BACKGROUND ART

Various internal combustion engines, pumps, vacuum pumps, etc. have used rectilinear reciprocating piston system for compressing or conveying a fluid. This rectilinear reciprocating piston system that moves two-way cannot evade one-way force or reaction force when changing the direction of movement. Even if these forces are offset by disposing a number of pistons in a row, there is a limit to offset against the piston forces or their reaction force applied to its main body and crank shaft at individual position.

Accordingly, the conventional rectilinear reciprocating piston system causes vibration and noise due to the rectilinear reciprocating motion of the pistons. In addition, as the rectilinear reciprocating motion of the pistons used in the internal combustion engine's cylinder is changed into a rotating motion through the crank shaft, a resultant force of the forces acting on the lower portions of the pistons each connected to the crank shaft is not zero with respect to the rectilinear reciprocating motion axis,of the pistons, which causes the cylinder to be eccentrically abraded and shortens the life of the whole machine system. A large and rigid component is used in order to assure the safety of the machine body, which makes the machine heavy.

DISCLOSURE OF THE INVENTION

Accordingly, the present invention is directed to an improved piston system that substantially obviates one or more of the problems due to limitations and disadvantages of the conventional art.

It is an objective of the present invention to provide a reciprocating rotary piston system which has a plurality of pistons alternately disposed on the same inner circumference of its cylinder, two adjacent parties of those pistons forward rotating and reversely rotating at the same speed and in the opposite direction with respect to each other in a way that their resultant force becomes zero, and reduces vibration, noise, and eccentric abrasion during operation, thus assuring a small-sized and light main body, long life of a machine, and high performance.

It is another objective of the present invention to provide various internal combustion engines, hydraulic and pneumatic pumps, and vacuum pumps using such an improved piston system.

To achieve the above objects, the present invention discloses a reciprocating rotary piston system comprising a cylinder having an annular and hollow interior; a plurality of pistons of which first and second parties are formed to be disposed alternately on the same inner circumference of the cylinder, the first and second parties of the pistons reciprocating along a given arc at the same speed and in the opposite direction with respect to each other; a plurality of intake valves mounted at each point of the cylinder where the two adjacent pistons meet for controlling flow of a fluid introduced thereinto from the outside; and a plurality of exhaust valves mounted at each point of the cylinder where the two adjacent pistons meet for controlling flow of a fluid forced out from the inside.

According to a first feature of the present invention, the cylinder includes an outer cylindrical part, first and second annular disks each joined to both sides of the outer cylindrical part, third and fourth annular disks each having an outer circumference joined to an inner circumference of each first and second annular disk, and an inner cylindrical part rotatably joined to an inner circumference of the respective third and fourth annular disks, wherein the first party of the pistons is connected to the third and fourth annular disks, and the second party of the pistons is joined to an outer surface of the inner cylindrical part. The first and second parties of the pistons turn in the opposite direction as the third and fourth annular disks and the inner cylindrical part turn in the relatively opposite direction with respect to each other.

According to a second feature of the present invention, the cylinder includes an outer cylindrical part, first and second annular disks each joined to both sides of the outer cylindrical part, and a first and second piston support bodies each having third and fourth annular disks each having an outer circumference joined to an inner circumference of each first and second annular disk, and first and second inner cylindrical parts extending inwardly from the-third and fourth annular disks.

In this case, the first party of the pistons is fixed to the first piston support body, the second party is fixed to the second piston support body, and the first and second parties of the pistons turn in the opposite direction as the first and second piston support bodies turn in the relatively opposite direction with respect to each other. The number of the plurality of pistons is 2n (n=positive constant more than 2).

The piston system is of symmetrical structure centering around its axis in order to minimize occurrance of vibration and noise.

The system further includes first and second driving means for reciprocating the first and second parties of the piston along a given arc within the cylinder at the same speed and in the opposite direction with respect to each other. In this case, the piston system constitutes one of a hydraulic pump, a pneumatic pump, and a vacuum pump.

The first and second driving devices include a torque generator, a first crank driving gear rotating by the torque, a second crank driving gear geared into the first crank driving gear and rotating, and first and second crank assemblies for making the first and second parties of the pistons reciprocate along a given arc within the cylinder as the first and second crank driving gears rotate.

According to another aspect of the present invention, the piston system further includes a plurality of spark plugs each installed in a plurality of chambers formed by rotating motions of the pistons for igniting a mixture of fuel and air introduced into each chamber through the intake valves whenever the pistons approach a top dead center or a bottom dead center; a controller controlling a plurality of intake valves, exhaust valves, and spark plugs so as to perform an intake stroke of the mixture, a compression stroke of the mixture, an expansion stroke of a burnt gas created by ignition of the mixture, and an exhaust stroke of the burnt gas in the plurality of chambers sequentially; first and second crank assemblies each connected to the first and second parties of the pistons reciprocating along a given arc within the cylinder at the same speed and in the opposite direction with respect to each other by the expansion stroke of the exhaust gas for converting the reciprocating motions into rotating motions; and first and second crank gears for generating a torque by adding rotating forces of the first and second crank assemblies acting in the opposite direction. The piston system constitutes an internal combustion engine, obtaining a torque from a rotating shaft of the first or second crank gear.

The interior of each of the plurality of pistons and the cylinder is one of square, oval, and circular shapes.

In the meantime, a reciprocating rotary internal combustion engine using the inventive piston system, includes a cylinder having an annular and hollow interior; a plurality of pistons of which first and second parties are formed to be disposed alternately on the same inner circumference of the cylinder, the first and second parties of the pistons reciprocating along a given arc at the same speed and in the opposite direction with respect to each other; a plurality of intake valves mounted at each point of the cylinder where the two adjacent pistons meet for controlling flow of a fluid introduced thereinto from the outside; a plurality of exhaust valves mounted at each point of the cylinder where the two adjacent pistons meet for controlling flow of a fluid forced out from the inside; a plurality of spark plugs each installed in a plurality of chambers formed by rotating motions of the pistons for igniting a mixture of fuel and air introduced into each chamber through the intake valves whenever the pistons approach a top dead center or a bottom dead center; a controller for controlling the plurality of intake valves, exhaust valves, and the spark plugs so as to perform an intake stroke of the mixture, a compression stroke of the mixture, an expansion stroke of a burnt gas created by ignition of the mixture, and an exhaust stroke of the burnt gas in the plurality of chambers; first and second crank assemblies each connected to the first and second parties of the pistons reciprocating along a given arc within the cylinder at the same speed and in the opposite direction with respect to each other by the expansion stroke of the exhaust gas for converting the reciprocating motions into rotating motions; and first and second crank gears for generating a torque by adding rotating forces of the first and second crank assemblies acting in the opposite direction. This internal combustion engine obtains a torque from a rotating shaft of the first or second crank gear.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BEST MODE FOR CARRYING OUT THE INVENTION

The preferred embodiment of the present invention will become apparent from a study of the following detailed description, when viewed in light of the accompanying drawings.

Figure 1:
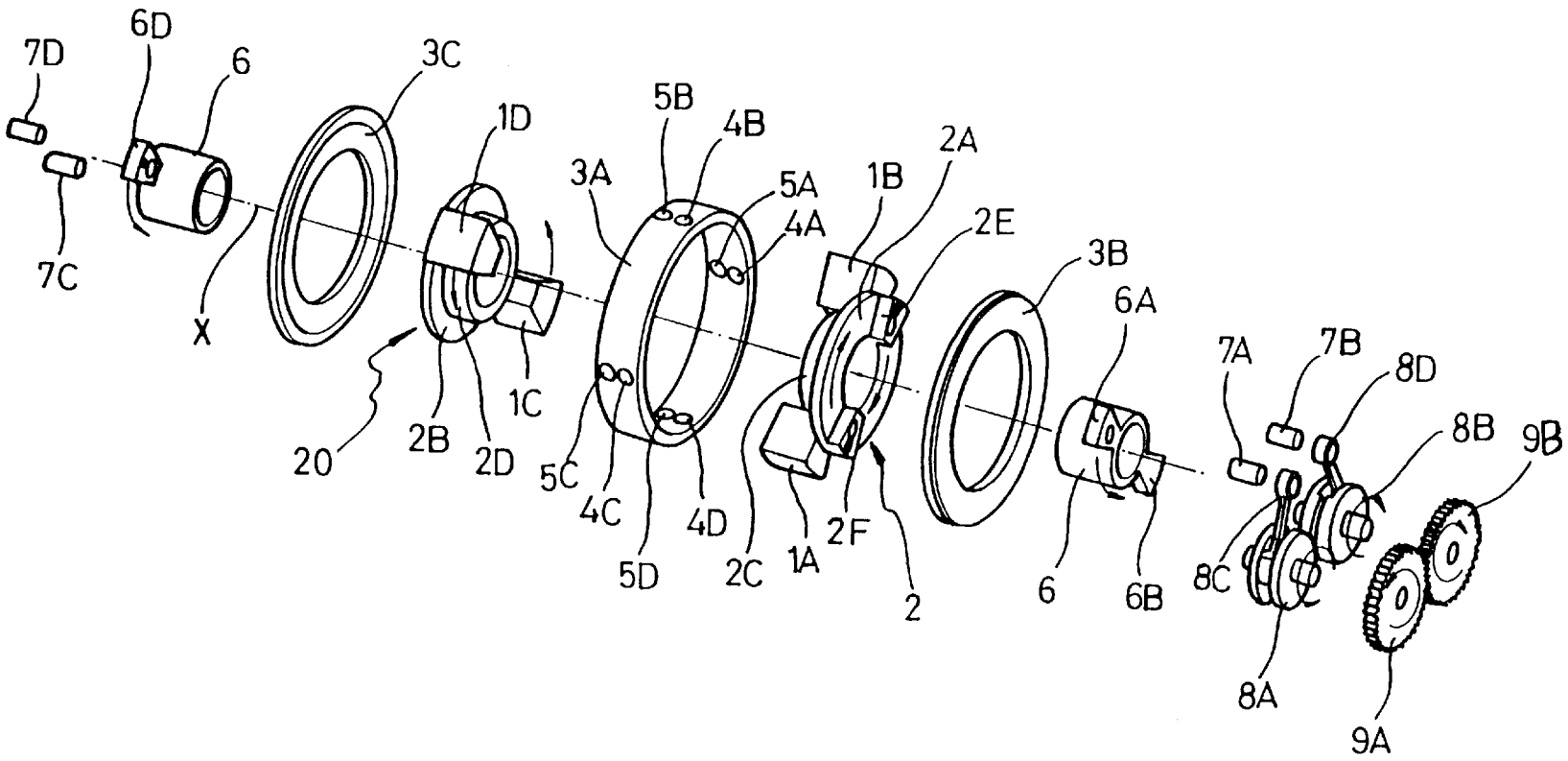
FIG. 1 is an exploded perspective view of a reciprocating rotary four-cylindered piston system constituting a pneumatic pump in accordance with a first preferred embodiment of the present invention.
Figure 2:
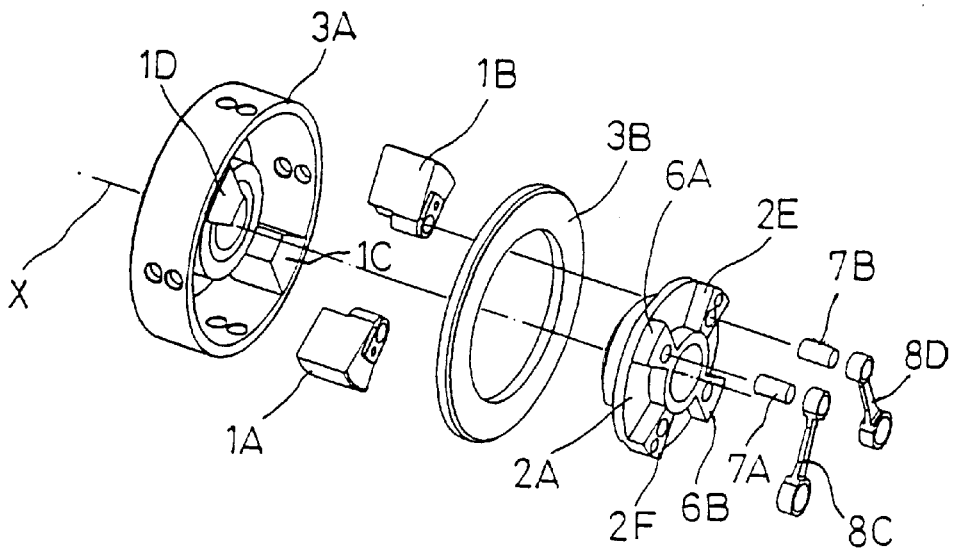
FIG. 2 is a perspective view of a partial assembly of FIG. 1.
Figure 3A:
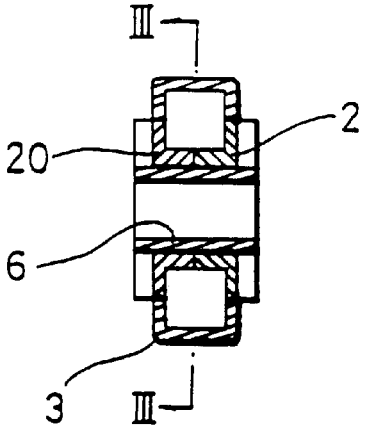
FIGS. 3A and 3B are each an axially sectional view of a cylinder assembly of the four-cylindered piston system in accordance with the first preferred embodiment of FIG. 1, and a sectional view as taken along line III—III of FIG. 3A.
Figure 3B:
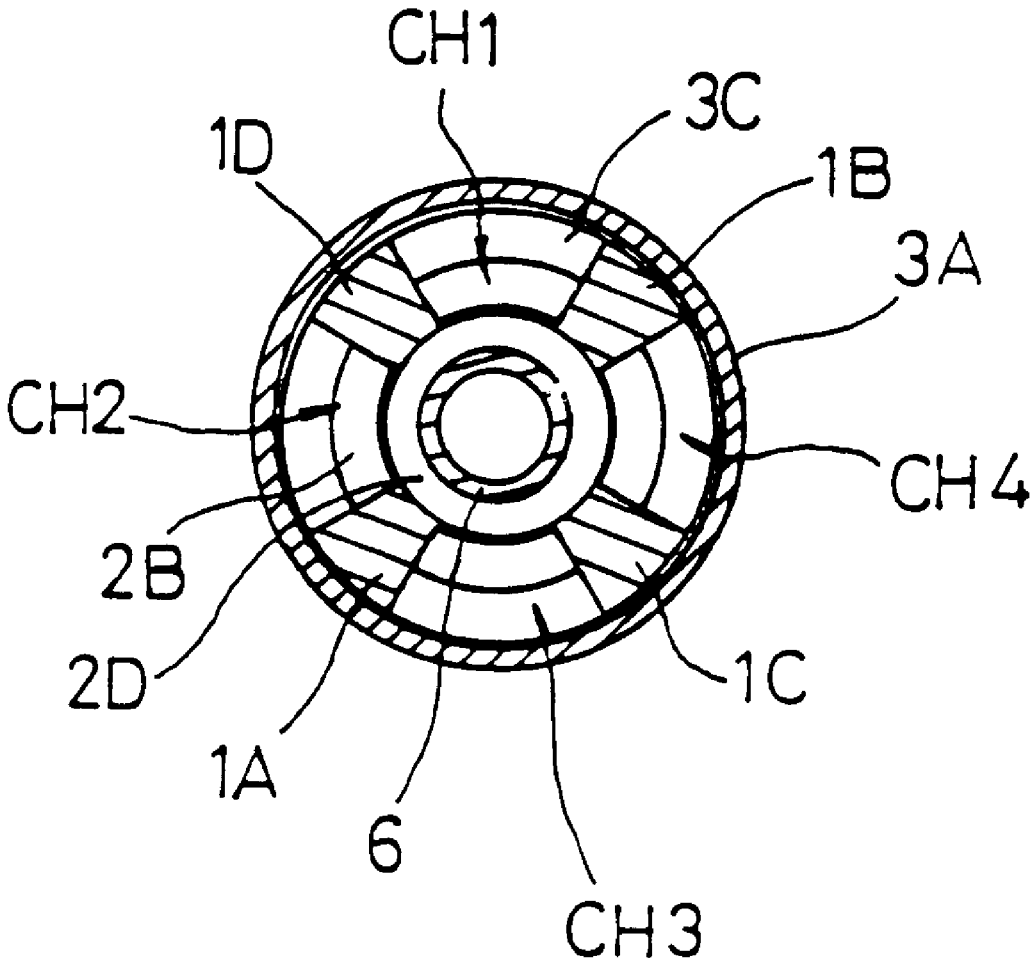

First to FIGS. 1 to 3, the reciprocating rotary four-cylindered piston system of the first preferred embodiment includes a cylinder 3 constituted by an outer cylindrical part 3A and left and right annular disks 3C and 3B each joined to both sides of outer cylindrical part 3A.

Annular disks 2A and 2B each having an outer diameter corresponding to the inner diameter of respective annular disks 3C and 3B are disposed within cylinder 3 along a central axis X's circumference, and inner cylindrical parts 2C and 2D forming the interior of cylinder 3 are formed extending to the inside of cylinder 3 within annular disks 2A and 2B. A pair of pistons 1A, 1B, 1C and 1D are fixedly mounted on the circumferential surface of each of inner cylindrical parts 2C and 2D to have a height and a width corresponding to cylinder 3's outer cylindrical part 3A.

First and second pistons 1A and 1B and third and fourth pistons 1C and 1D are opposed to each other on the basis of axis X, and they are each alternately disposed on four sides. First piston 1A and second piston 1B rotate within cylinder 3 as a first piston support body 2 turns, and third and fourth pistons 1C and 1D rotates as a second piston support body 20 turns.

Four intake valves 4A to 4D and exhaust valves 5A to 5D are mounted on cylindrical part 3A of cylinder 3 at 90° intervals, and they are on each point where two adjacent pistons meet when each of first to fourth pistons 1A to 1D simultaneously rotates or reversely rotates by 90° in the opposite direction with respect to the adjacent piston (actually, each of them rotates by the angle smaller than 90° by its width angle). First and second lugs 2E and 2F for limiting rotation are formed on piston support body 2's annular disk 2A corresponding to pistons 1A and 1B. A connection pin 7B is fastened to piston 1B and first lug 2E via a bolt, and has other end hinged on one end of a crank rod 8D of a second crank 8B to convert the reciprocating motions of pistons 1A and 1B into a one-way rotating motion or to convert the one-way rotating motion into the reciprocating motions of pistons 1A and 1B.

A connection shaft 6 is rotatably inserted to the inside of each inner cylindrical part 2C and 2D, and third and fourth lugs 6A and 6B for limiting rotation are provided to shaft 6's one end to alternate with first and second lugs 2E and 2F. At the other end of connection shaft 6 are formed fifth and sixth lugs 6C and 6D corresponding to pistons 1C and 1D and extending like third and fourth lugs 6A and 6B. Pistons 1C and 1D and connection shaft 6's fifth and sixth lugs 6C and 6D are fastened to each other by connection pins 7C and 7D and bolts. Connection shaft 6 is actually a single body, and is divided into two for more detailed description.

Third lug 6A is connected to one end of a connection pin 7A, and the other end of connection pin 7A is hinge-joined to a crank rod 8C of a first crank 8A in order to either convert the reciprocating motions of each piston 1C and 1D into one-way rotating motion or convert the one-way rotating motion into the reciprocating motions of each piston 1C and 1D.

As first crank 8A rotates counterclockwise, connection pin 7A, third lug 6A, connection shaft 6, and sixth lug 6D also rotate counterclockwise so that piston support body 20 and pistons 1C and 1D also turn counterclockwise.

First and second crank gears 9A and 9B are axially joined to first and second cranks 8A and 8B, and have the same diameter and geared into each other. Thus, if first crank gear 9A turns counterclockwise, second crank gear 9B turns clockwise. Therefore, when first crank gear 9A turns counterclockwise, pistons 1C and 1D rotate counterclockwise, and second crank gear 9B turns clockwise so pistons 1A and 1B also rotate clockwise. That is, pistons 1A and 1B turn forward or reversely in the opposite direction with respect to pistons 1C and 1D all the time.

When the rotating force generated by a motor and the like is applied to first crank gear 9A, and intake valves 4A to 4D and exhaust valves 5A to 5D connected to a compression tank are properly controlled, this first preferred embodiment constitutes a pneumatic (air pressure) pump. In this case, an interface between piston support bodies 2 and 20, an interface between piston support body 2 and a right annular disk 3A, and another interface between piston support body 20 and left annular disk 3C should be precisely manufactured to form a seal in a way that pistons 1A to 1D rotatably disposed within square pipe-shaped cylinder 3 divide the interior of cylinder 3 into four hermetic chambers CH1 to CH4. Preferably, a plurality of bearings are used to reduce friction between the adjacent components and to smooth the rotation, which is omitted for convenience' sake.

Figure 4:
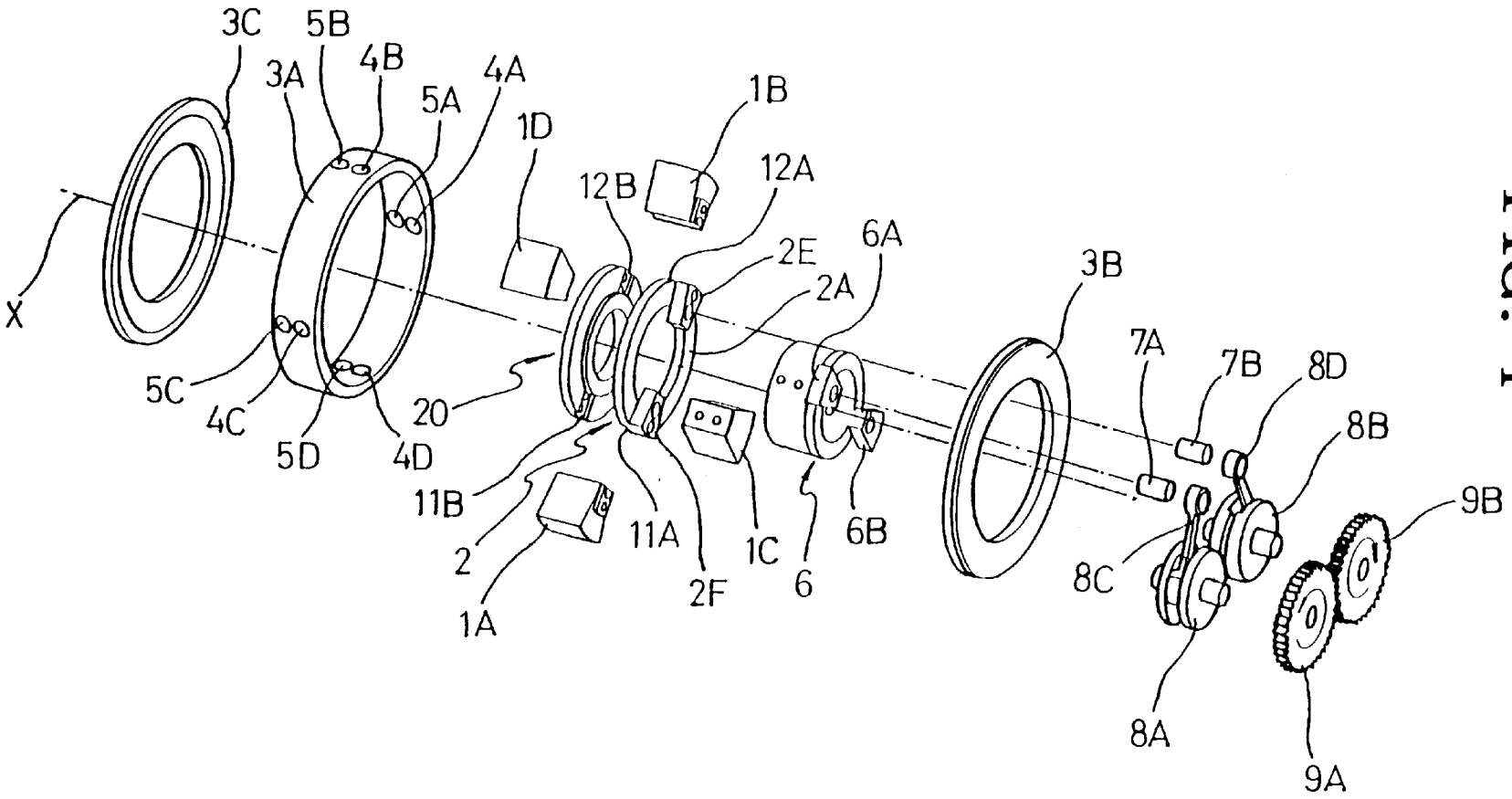
FIG. 4 is an exploded perspective view of a reciprocating rotary four-cylindered piston system in accordance with a second preferred embodiment of the present invention.
Figure 5A:
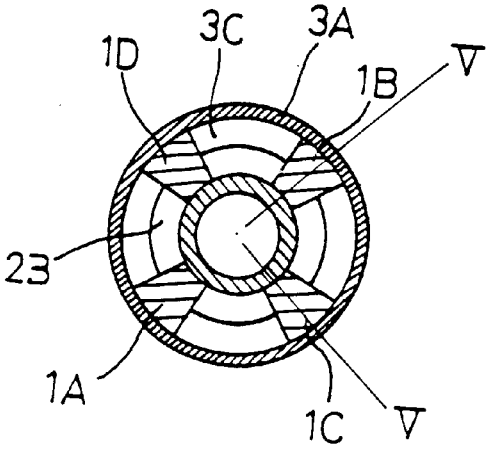
FIGS. 5A and 5B are each a sectional view of a cylinder assembly of a four-cylindered piston system in accordance with the second preferred embodiment of FIG. 4, and a sectional view as taken along line V—V of FIG. 5A.
Figure 5B:
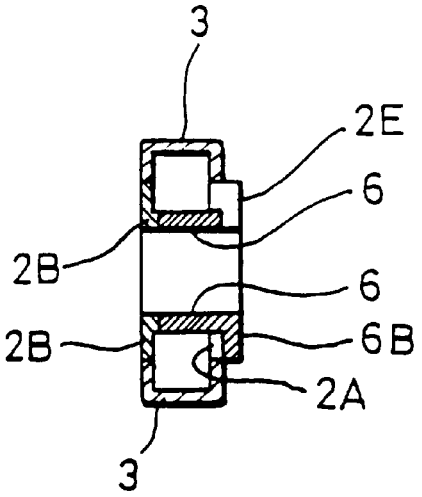

FIG. 4 is an exploded perspective view of a reciprocating rotary four-cylindered piston system in accordance with a second preferred embodiment of the present invention, and what is different from the first preferred embodiment pistons is the mechanism of supporting and driving pistons 1A to 1D.

First and second pistons 1A and 1B are securely fitted into inner races 11A, 11B, and 12A, 12B of first and second piston support bodies 2 and 20, and third and fourth pistons 1C and 1D are directly connected to an outer circumference of a connection shaft 6 forming an inner cylindrical part.

A first crank 8A is connected to a third lug 6A protruding from one side of connection shaft 6 through a crank rod 8C and a connection pin 7A, and second crank 8B is connected to a first lug 2E protruding from one side of first piston support body 2 through a crank rod 8D and a connection pin 7B.

Cylinder 3 or crank gears 9A and 9B of the second preferred embodiment are formed to be the same as those of the first preferred embodiment. Such a reciprocating rotary four-cylindered piston system of the second embodiment of the present invention is more simple than the first embodiment's in structure, and in the piston operating mechanism, first and second piston support bodies 2 and 20 turn in the same direction, contrary to the first preferred embodiment's. Other than this, the rest of the piston operating mechanism in accordance with the second preferred embodiment is the same as the first preferred embodiment's so the description thereabout will be omitted.

According to the features of the second preferred embodiment, the turning center of the respective rotating bodies may converge on one point, and there is no need to use extra counterweights for keeping balance, thus reducing the overall weight of the system.

The operation of the inventive four-cylindered piston system is now fully described referring to FIG. 6.

Figure 6A:
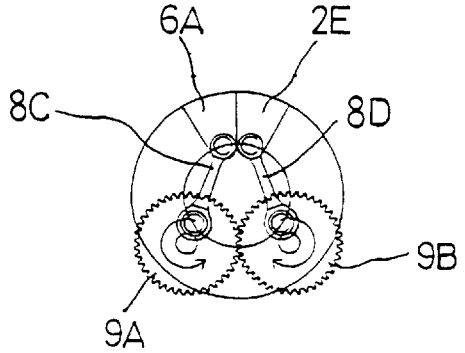
FIG. 6A depicts the operating state of the inventive four-cylindered piston system's crank assembly by stages.
Figure 6A:
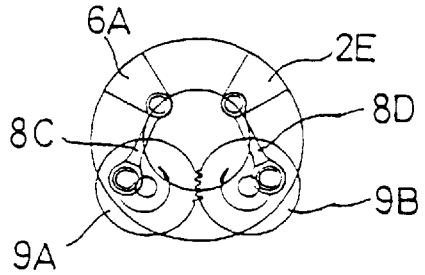
Figure 6A:
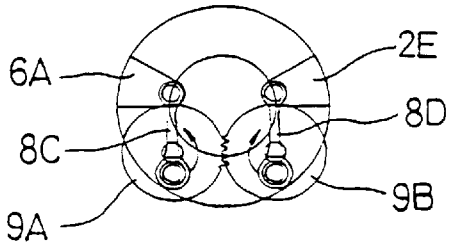
Figure 6A:
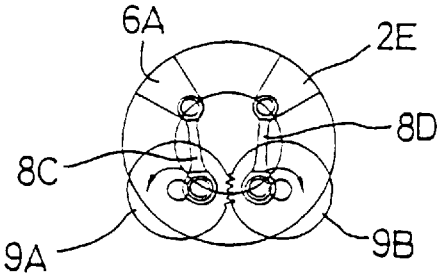
Figure 6A:
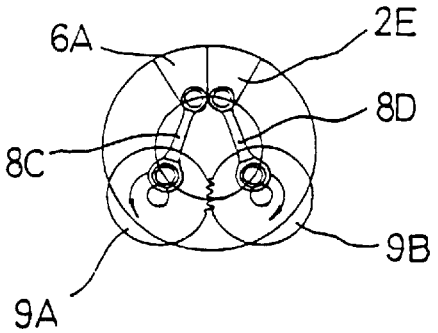
Figure 6B:
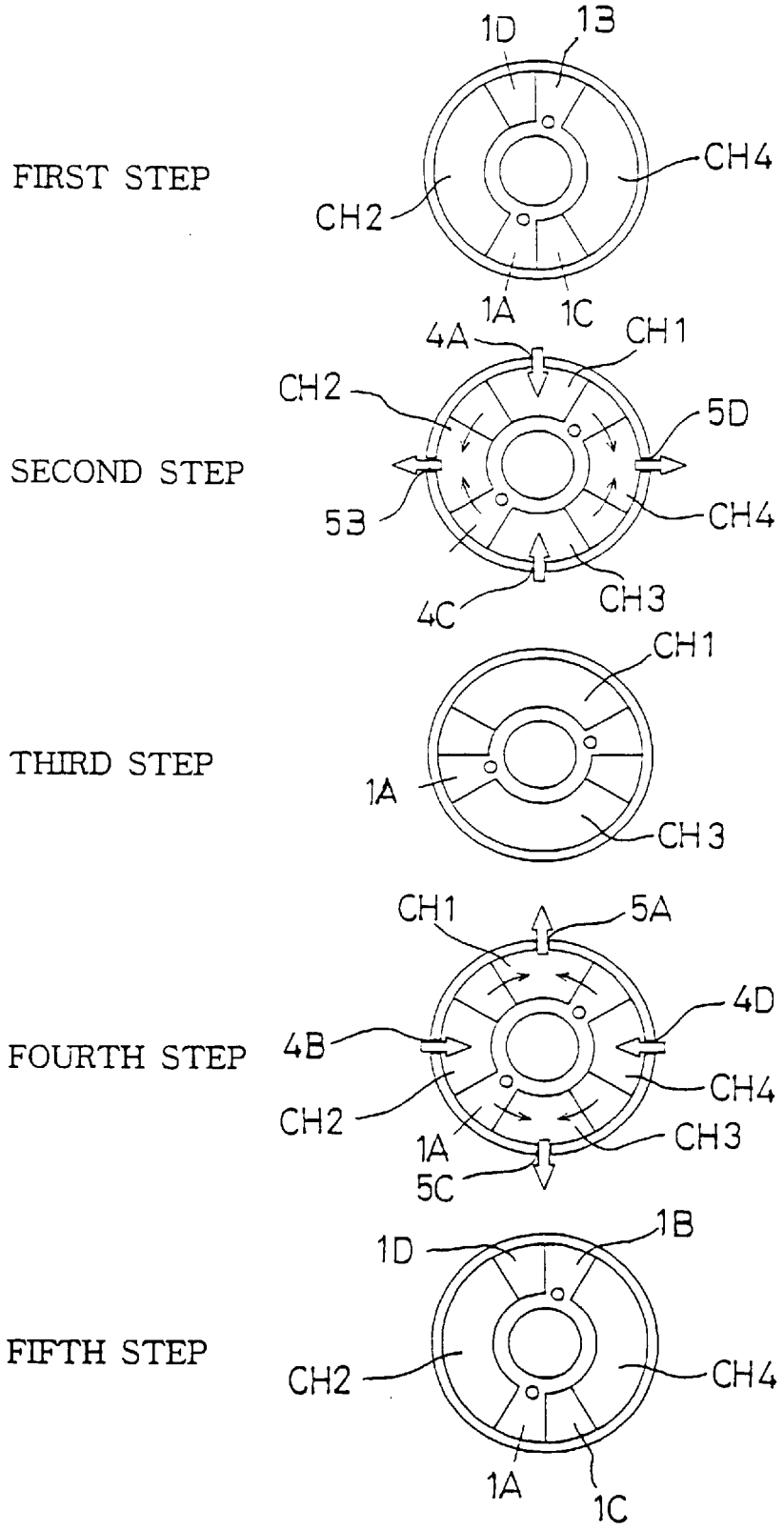
FIG. 6B depicts the operating state of the present invention use for a pneumatic pump by steps.
Figure 6C:
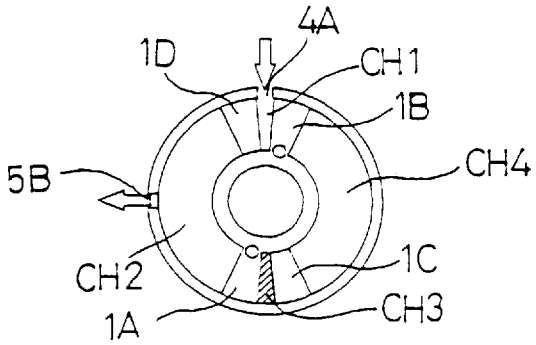
FIG. 6C depicts the operating state of the present invention used for an internal combustion engine.
Figure 6C:
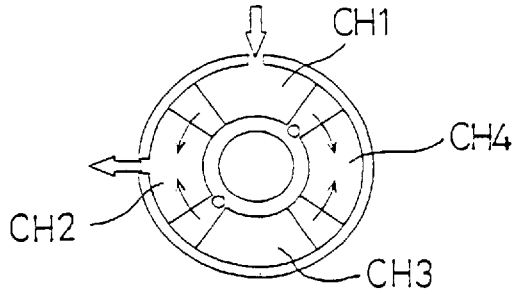
Figure 6C:
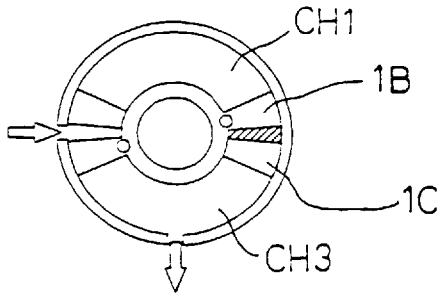
Figure 6C:
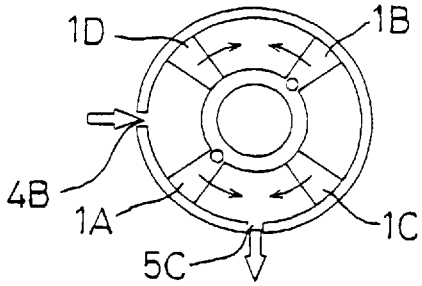
Figure 6C:
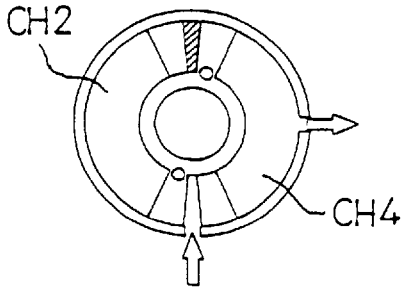

FIG. 6A depicts the operating state of the inventive four-cylindered piston system's crank assembly by steps, FIG. 6B depicts the operating state of the present invention used for a pneumatic pump by steps, and FIG. 6C depicts the operating state of the present invention used for an internal combustion engine.

Referring first to FIGS. 6A and 6B, the present invention applied for a pneumatic pump will be described.

In the first step, pistons 1A to 1D stop rotation and change rotating direction to the right/left. In this step, the respective chambers CH1 and CH3 are of minimum internal volume and the respective chambers CH2 and CH4 are of maximum internal volume, and this is the step of changing the rotating direction while the air inside the chambers CH1 to CH4 stops flowing.

Intake valves 4A to 4D and exhaust valves 5A to 5D of all the chambers CH1 to CH4 are each in a closed state, and the respective crank rods 8C and 8D are on the top dead center (TDC).

In the second step, when clockwise or counterclockwise rotating force is applied to crank gear 9A or 9B from the outside, pistons 1A and 1B are rotating clockwise and pistons 1C and 1D are turning clockwise, and chamber CH2 and CH4 are reduced in volume so the inside air flows out through exhaust valves 5B and 5D. Chambers CH1 and CH3 are increased in volume so that the outside air is introduced to the interior through intake valves 4A and 4C.

According to the third step, crank rods 8C and 8D reach the bottom dead center (BDC) as crank gears 9A and 9B rotate, and pistons 1A to 1D stop rotating and change to the right/left. Contrary to the first step, chambers CH1 and CH3 are maximum in internal volume and chambers CH2 and CH4 are minimum therein, and the inside air stops flowing. In this case, intake valves 4A to 4D and exhaust valves 5A to 5D of all the chambers CH1 to CH4 are each in a closed state.

In the fourth step, contrary to the second step, pistons 1A and 1B are rotating counterclockwise and pistons 1C and 1D are rotating clockwise, and chambers CH2 and CH4 are increased in volume so the outside air is introduced thereinto through intake valves 4B and 4D, while chambers CH1 and CH3 are minimized in volume so the inside air flows out through exhaust valves 5A and 5C.

The fifth step shows that after the crank assembly completes one rotation, it returns to the first step.

When it comes to the track of each piston, piston 1A reciprocates along a given arc in a third quarter of the face, second piston 1B, third piston 1C, and fourth piston 1D are reciprocating along a given arc of the same length in a first quarter, a fourth quarter, and a second quarter of the face, respectively.

Referring to FIGS. 6A and 6C, the present invention applied to an internal combustion engine is now described. First to fourth spark plugs (not shown) must be provided to each chamber CH1 to CH4 in order to ignite the explosive mixture of fuel and air.

In the first step, pistons 1A and 1C are pushed to both sides by gas pressure generated in an explosion stroke when the third spark plug ignites the mixture in third chamber CH3, and the gas in third chamber CH3 expands. As a result, the volume of first chamber CH1 is increased, and it starts an intake stroke for receiving the mixture from an intake manifold through intake valve 4A. On the contrary, second and fourth chambers CH2 and CH4 are decreased in volume, and second chamber CH2 starts an exhaust stroke for forcing the burnt gas out through exhaust valve 5B to an exhaust manifold while fourth chamber CH4 starts a compression stroke of the received mixture.

In the second step, the gas in third chamber CH3 expands, and first chamber CH1, second chamber CH2, and fourth chamber CH4 continue intake, exhaust, and compression strokes, respectively.

In the third step, if explosion occurs by ignition of the mixture in fourth chamber CH4 in which compression has been completed, pistons 1B and 1C are pushed to both sides by gas pressure as in the first step, and first chamber CH1, second chamber CH2, and third chamber CH3 start off compression, intake, and exhaust strokes, respectively.

According to the fourth step, first chamber CH1, second chamber CH2, and third chamber CH3 respectively keep on compression, intake, and exhaust strokes by gas pressure of fourth chamber CH4.

In the fifth step, explosion occurs in first chamber CH1, and second chamber CH2, third chamber CH3, and fourth chamber CH4 start off compression, intake, and exhaust strokes, respectively.

As described above, the preferred embodiment shown in FIG. 6C constitutes a four-cylindered and four-stroke internal combustion engine.

According to the crank operation of the four-cylindered and four-stroke engine (FIG. 6C's second step), first and third pistons 1A and 1C are pushed to the right/left by gas pressure generated by ignition of the explosive mixture, and first and third lugs 2E and 6A, contrary to the pump operation, rotate clockwise and counterclockwise, respectively. As a result, clockwise and counterclockwise rotating forces are each applied to second and first crank rods 8D and 8C through connection pins 7B and 7A. Therefore, since first and second crank gears 9A and 9B, connected to first and second cranks, turn counterclockwise and clockwise, torque is obtained from the rotary shaft of first or second crank gear 9A or 9B.

In this case, components of first crank 8A are oppositely disposed with respect to second crank 8B's, and these operate in the opposite direction so vibrations created by them are offset, thps minimizing a mechanical vibration.

First and second preferred embodiments show the square interior of the cylinder and square section of the piston, and they are not limited to the square shape but may be circular or polygonal.

In the above preferred embodiments, four intake valves 4A to 4D and exhaust valves 5A to 5D are each disposed at 90° intervals on outer cylindrical part 3A, and they may be installed on left and right annular disks 3C and 3B.

As described above, in the present invention a plurality of pistons are disposed on the same circumferential face, and the adjacent pistons of them constantly rotate at the same speed and in the opposite direction, thus fundamentally preventing deformation of system components. The inventive crank assemblies and other components are symmetrically arranged to offset action forces and reaction forces created by movement of the respective components and to make a resultant force of the pistons between piston operating mechanisms zero, thereby reducing vibration and noise.

In addition, in the structure of the present invention, since main components such as the cylinder, piston support bodies, pistons concentrically support each other for rotation, this prevents a gap between the adjacent components and reduces eccentric abrasion, thus increasing the life of a machine. In comparison of a conventional multi-cylindered piston system having components disposed transversely, the inventive piston system is of even smaller size and reduces stiffness of each component thereby assuring light-weight machine.

According to FIG. 4's second preferred embodiment of the present invention, a piston system with a cylindrical main body of 22 cm, 7 cm, and 1500 cc in diameter, width piston, and displacement can be manufactured. Accordingly, when comparing this with a conventional cylinder block for a pneumatic pump or internal combustion engine, there are big differences between the present invention and the conventional one in size and displacement.

The above preferred embodiments of the present invention concern the piston system, a hydraulic, a pneumatic pump, a vacuum pump, and an internal combustion engine, and may be variously modified within the spirit and scope of the present invention. For example, the structure of the pneumatic pump may be directly used for the hydraulic pump, and the vacuum pump is accomplished by connecting parts to be vacuumized to intake valves, contrary to the pneumatic pump.

The above preferred embodiments have described a four-cylindered piston system, but as pistons of 2n (n=positive constant more than two) more than four in number, six-, eight-, ten-cylindered piston systems can be easily manufactured according to the present invention. For example, when the piston system has six pistons, they form two trios, and are connected to crank assemblies so as to make adjacent pistons turn in the opposite direction with respect to one another.

In the above preferred embodiments of the present invention, pistons in odd number are divided into two parties and two cranks drive them in the opposite direction with respect to each other, but any crank assemblies that are capable of driving the pistons of two parties in the opposite direction is applicable to the invention. Besides, the above embodiments depict a single piston system, and displacement may be increased by arranging these piston systems in parallel.

Industrial Applicability

The present invention is applicable to a reciprocating rotary piston system, and a hydraulic pump, a pneumatic pump, a vacuum pump and an internal combustion engine using the same.

The invention now being fully described, it will be apparent to one of ordinary skill in the art that many changes and modifications can be made thereto without departing from the spirit or scope of the appended claims.

What is claimed is:

1. A reciprocating rotary piston system comprising:

a cylinder having an annular and hollow interior, the cylinder including:

an outer cylindrical part;

first and second annular disks each joined to both sides of the outer cylindrical part;

third and fourth annular disks each having an outer circumference corresponding to an inner circumference of said outer cylindrical part; and a pair of inner cylindrical parts respectively rotatably joined to an inner circumference of the third and fourth annular disks;

a plurality of pistons of which first and second pairs are formed to be disposed alternately on the inner circumference of the outer cylindrical part, the first and second pairs of pistons reciprocating along a given arc at the same speed and in opposite directions with respect to each other, the first pair of pistons being connected to the inner cylindrical part joined to the third annular disks, and the second pair of pistons being joined to the inner cylindrical part joined to the fourth annular disk, the first and second pairs of the pistons turn in an opposite direction as said third and fourth annular disks and the inner cylindrical parts turn in opposite directions th respect to each other;

a plurality of intake valves mounted at each point of the outer cylindrical part corresponding to locations where two adjacent pistons meet for controlling flow of a fluid introduced thereinto from external the cylinder; and a plurality of exhaust valves mounted at each point of the outer cylindrical part corresponding to the locations where two adjacent pistons meet for controlling flow of a fluid forced out from the within the cylinder.

2. The piston system according to claim 1, wherein a number of the plurality of pistons is 2n wherein n is a positive constant more than 2.

3. The piston system according to claim 1, wherein a resultant force of the turning pistons is zero.

4. The piston system according to claim 1, wherein the piston system is a symmetrical structure centering around its axis.

5. The piston system according to claim 1, wherein an interior of each of the plurality of pistons and the cylinder is one of square, oval, and circular shapes.

6. The piston system according to any one of claims 1, 2, 3, 4 or 5, further comprising first and second driving means for reciprocating the first and second pairs of pistons along the given arc within the cylinder at the same speed and in the opposite directions with respect to each other, the piston system constituting one of a hydraulic pump, a pneumatic pump, and a vacuum pump.

7. The piston system according to claim 6, wherein the first and second driving means comprise means for generating a rotating torque; a first crank driving gear rotating by the torque; a second crank driving gear geared to the first crank driving gear and rotating together with the first crank driving gear; and first and second crank assemblies for making the first and second pairs of pistons reciprocate along the given arc within the cylinder as the first and second crank driving gears rotate.

8. The piston system according to any one of claims 1, 2, 3, 4 or 5, further comprising:

a plurality of spark means each installed in a plurality of chambers formed by rotating motions of the pistons for igniting a mixture of fuel and air introduced into each chamber through the intake valves whenever the pistons approach predetermined positions;

control means for controlling a plurality of intake valves, exhaust valves, and spark means to perform an intake stroke of the mixture, a compression stroke of the mixture, an expansion stroke of a burnt gas created by ignition of the mixture, and an exhaust stroke of the burnt gas in the plurality of chambers sequentially;

first and second crank assemblies respectively connected to the first and second pairs of pistons reciprocating along the given arc within the cylinder at the same speed and in the opposite direction with respect to each other by the expansion stroke of the exhaust gas for converting the reciprocating motions into rotating motions; and first and second crank gears for generating a single torque by unifying rotating forces of the first and second crank assemblies acting in opposite directions, wherein said piston system forms an internal combustion engine for obtaining a torque from a rotating shaft of one of the first and second crank gears.

9. The piston system according to any one of claims 1, 2, 3, 4 or 5, wherein the plurality of intake valves and exhaust valves are installed on one of an outer surface, left and right sides of the cylinder.

10. A reciprocating rotary piston system comprising:

a cylinder having an annular and hollow interior, the cylinder including:

an outer cylindrical part;

first and second annular disks each joined to both sides of the outer cylindrical part; and a first piston support body and a second piston support body each having a respective third and fourth annular disk, each of the third and fourth annular disks having an outer circumference corresponding to an inner circumference of said outer cylindrical part, and first and second inner cylindrical parts respectively extending inwardly from the third and fourth annular disks;

a plurality of pistons of which first and second pairs are formed to be disposed alternately on the inner circumference of the outer cylindrical part, the first and second pairs of pistons reciprocating along a given arc at the same speed and in opposite directions with respect to each other, the first pair of pistons being fixed to the first piston support body, and the second pair of pistons being fixed to the second piston support body, the first and second pairs of pistons turn in opposite directions as the first and second piston support bodies turn in opposite directions with respect to each other;

a plurality of intake valves mounted at each point of the outer cylindrical part corresponding to locations where two adjacent pistons meet for controlling flow of a fluid introduced thereinto from external the cylinder; and a plurality of exhaust valves mounted at each point of the outer cylindrical part corresponding to the locations where two adjacent pistons meet for controlling flow of a fluid forced out from the within the cylinder.

11. A reciprocating rotary internal combustion engine comprising:

a cylinder having an annular and hollow interior;

a plurality of pistons of which first and second parties are formed to be disposed alternately on the same inner circumference of the cylinder, the first and second parties of the pistons reciprocating along a given arc at the same speed and in the opposite direction with respect to each other;

a plurality of intake valves mounted at each point of the cylinder where the two adjacent pistons meet for controlling flow of a fluid introduced thereinto from the outside;

a plurality of exhaust valves mounted at each point of the cylinder where the two adjacent pistons meet for controlling flow of a fluid forced out from the inside;

a plurality of spark means each installed in a plurality of chambers formed by rotating motions of the pistons for igniting a mixture of fuel and air introduced into each chamber through the intake valves whenever the pistons approach a top dead center or a bottom dead center;

control means for controlling a plurality of intake valves, exhaust valves, and the spark means so as to perform an intake stroke of the mixture, a compression stroke of the mixture, an expansion stroke of a burnt gas created by ignition of the mixture, and an exhaust stroke of the burnt gas in the plurality of chambers sequentially;

first and second crank assemblies each connected to the first and second parties of the pistons reciprocating along a given arc within the cylinder at the same speed and in the opposite direction with respect to each other by the expansion stroke of the exhaust gas for converting the reciprocating motions into rotating motions; and first and second crank gears for generating a torque by unifying rotating forces of the first and second crank assemblies acting in the opposite direction, said internal combustion engine obtaining a torque from a rotating shaft of the first or second crank gear.

12. A reciprocating rotary hydraulic/pneumatic pump comprising:

a cylinder having an annular and hollow interior, the cylinder including:

an outer cylindrical part;

first and second annular disks each joined to both sides of the outer cylindrical part;

third and fourth annular disks each having an outer circumference corresponding to an inner circumference of said outer cylindrical part; and a pair of inner cylindrical parts respectively rotatably joined to an inner circumference of the third and fourth annular disks;

a plurality of pistons of which first and second pairs are formed to be disposed alternately on the inner circumference of the outer cylindrical part, the first and second pairs of pistons reciprocating along a given arc at the same speed and in opposite directions with respect to each other, the first pair of pistons being connected to the inner cylindrical part joined to the third annular disks, and the second pair of pistons being joined to the inner cylindrical part joined to the fourth annular disk, the first and second pairs of the pistons turn in an opposite direction as said third and fourth annular disks and the inner cylindrical parts turn in opposite directions with respect to each other;

a plurality of intake valves mounted at each point of the outer cylindrical part corresponding to locations where two adjacent pistons meet for controlling flow of a fluid introduced thereinto from external the cylinder;

a plurality of exhaust valves mounted at each point of the outer cylindrical part corresponding to the locations where two adjacent pistons meet for controlling flow of a fluid forced out from the within the cylinder; and first and second driving means for reciprocating the first and second pairs of the piston along the given arc within the cylinder.

* * * * *